US007705252B2

(12) United States Patent
Merletti

(10) Patent No.: US 7,705,252 B2
(45) Date of Patent: Apr. 27, 2010

(54) ROTARY CONTROL DEVICE

(75) Inventor: Didier Merletti, Saint Sorlin (FR)

(73) Assignee: Bosch Rexroth D.S.I., Venissieux (FR)

( * ) Notice: Subject to any disclaimer, the term of this patent is extended or adjusted under 35 U.S.C. 154(b) by 488 days.

(21) Appl. No.: 11/791,831

(22) PCT Filed: Sep. 26, 2005

(86) PCT No.: PCT/FR2005/002377

§ 371 (c)(1),
(2), (4) Date: Jul. 5, 2007

(87) PCT Pub. No.: WO2006/079695

PCT Pub. Date: Aug. 3, 2006

(65) Prior Publication Data

US 2008/0110742 A1 May 15, 2008

(30) Foreign Application Priority Data

Jan. 26, 2005 (FR) ..... 05 00799

(51) Int. Cl.
*H01H 9/00* (2006.01)

(52) U.S. Cl. ..... 200/4; 200/61.88; 200/14

(58) Field of Classification Search ..... 200/4, 200/5 R, 6 R, 6 A, 17 R, 18, 14, 11 TW, 61.85, 200/61.88, 1 B, 61.28, 329, 332.1, 332.2, 200/339, 553, 558, 561
See application file for complete search history.

(56) References Cited

U.S. PATENT DOCUMENTS

| | | | | |
|---|---|---|---|---|
| 6,713,693 | B1 * | 3/2004 | Sadowski et al. | 200/18 |
| 6,750,409 | B1 * | 6/2004 | Samodell | 200/50.32 |
| 6,803,683 | B2 * | 10/2004 | Bone et al. | 310/50 |
| 6,810,265 | B2 * | 10/2004 | Tochihara | 455/550.1 |
| 6,884,948 | B2 * | 4/2005 | Gotoh | 200/6 A |
| 6,989,497 | B1 * | 1/2006 | Lee | 200/6 A |
| 7,238,905 | B2 * | 7/2007 | Oh | 200/339 |
| 7,439,459 | B2 * | 10/2008 | Hyun et al. | 200/5 R |
| 7,572,991 | B2 * | 8/2009 | Du et al. | 200/14 |
| 2004/0056624 | A1 | 3/2004 | Hayasaka | |

FOREIGN PATENT DOCUMENTS

| | | |
|---|---|---|
| EP | 1 111 635 A2 | 6/2001 |
| FR | 2 855 904 A1 | 12/2004 |
| JP | A 5-57645 | 3/1993 |

* cited by examiner

*Primary Examiner*—Michael A Friedhofer
(74) *Attorney, Agent, or Firm*—Oliff & Berridge, PLC

(57) ABSTRACT

The invention relates to a rotary control device intended, in particular, for being fixed to a handle of a remote control of a heavy-construction machine, comprising: a housing to be fastened to the handgrip in a fixed manner; a moving actuating part that rotates relative to the housing about an axis; first means for generating a rate control signal starting from the angular position of the moving actuating part, comprising a moving part driven by the actuating part and a part fixed to the housing, the moving actuating part being able to be driven by the operator in two opposite directions starting from a home position up to elastic means.

20 Claims, 9 Drawing Sheets

ROTARY CONTROL DEVICE

BACKGROUND OF THE INVENTION

The present invention relates to a rotary control device designed in particular to be attached to a handle of a remote control of a heavy construction machine.

DESCRIPTION OF THE PRIOR ART

A remote control of a heavy construction machine comprises, in a known manner, a handle that can be moved according to at least one degree of freedom relative to a support, the movement of this handle allowing an operator to control at least one receiving member external to the remote control.

In order to increase the number of receiving members that can be controlled or to make it possible to vary the control instructions, it is a known practice to add to the remote control devices that can be controlled by the fingers of the user, and in particular devices of the proportional type.

Among these devices, it is a known practice to use rotary control devices that usually comprise:

a casing designed to be fixedly attached to the handle, a movable actuation portion that can be rotated relative to the casing about an axis, means for generating a control signal based on the angular position of the movable actuation portion comprising a movable portion and a portion fixedly attached to the casing.

The means for generating a control signal, preferably of the contactless type, may comprise for example a magnet rotatably attached to the actuation portion and a Hall effect sensor.

This type of control device also comprises elastic means making it possible to return the movable actuation portion to a rest position, from which the operator may move this portion in two opposite directions.

Such types of devices give satisfaction for the control of receiving members in normal conditions of use.

It is however desirable to provide means for protecting the control device, by ensuring the redundancy of the information. In particular, this redundancy makes it possible to identify incorrect information in the case of a short circuit between the wires conveying the signal.

In addition, it is desirable to supply the information on the direction of actuation directly to a supervision module that can therefore block an "aggravating movement" that can cause the machine to overturn.

It should be noted that the control devices must also comply with constraints of minimal space requirement and simplicity of installation on the remote control.

The object of the present invention is to provide a solution making it possible to solve in particular the two technical problems explained above by ensuring a redundancy of the information making it possible to detect dangerous situations or malfunctions of the control, while retaining the same simplicity of installation.

SUMMARY OF THE INVENTION

Accordingly, the subject of the present invention is a rotary control device designed in particular to be attached to a handle of a remote control of a heavy construction machine, comprising:

a casing designed to be fixedly attached to the handle, a movable actuation portion that can be rotated relative to the casing about an axis, first means for generating a proportional control signal based on the angular position of the movable actuation portion, comprising a movable portion moved by the actuation portion and a portion fixedly attached to the casing, the movable actuation portion being able to be moved by the operator in two opposite directions from a rest position against elastic means, which device also comprises second means for generating at least one signal of the on/off type delivering a first signal value when the actuation portion is oriented in a first direction relative to the rest position, beyond a first threshold, and delivering a second signal value when the actuation portion is oriented in a second direction relative to the rest position, beyond a second threshold.

Thanks to these arrangements, the device provides redundant information. The information on the direction of actuation of the actuation portion given by the first generation means may be compared with the information provided by the second generation means in order to detect a malfunction.

In addition, to prevent aggravating movements, it is possible to block the control of a receiving member when the information provided by the second generation means indicates that the control of the receiving member is carried out in the direction of such a movement.

Advantageously, the second means for generating a signal are placed on the casing of the device.

According to one possibility, the second means for generating a signal comprise at least one member that is movable, particularly in translation, moved by the actuation portion against elastic return means.

Advantageously, the actuation portion comprises at least one ramp or a bearing abutment designed for the movement of the movable member.

Advantageously, the output signal of the second generation means consists of two individual signals on two output channels.

According to one embodiment, the second means for generating a signal comprise at least one pushbutton that can be actuated during the movement of the movable member.

According to another embodiment, the movable member comprises conductive elements designed to enter into contact with at least one conductive track in at least one position of the device.

Advantageously, the conductive elements are in open circuit in the rest position of the device.

Advantageously, the conductive elements comprise flexible brushes making an electric sliding contact with at least one electric track in at least one position of the device.

According to one embodiment, the second generation means comprise first means for detecting the movement of the actuation portion in a first direction relative to the rest position and second means for detecting the movement of the actuation portion in a second direction relative to the rest position.

According to one possibility, the second generation means comprise detection means of the on/off type.

According to another possibility, the second generation means comprise detection means of the proportional type associated with means for comparing the value supplied by the detection means with at least one threshold.

According to one embodiment, the detection means of the proportional type are common with those used by the first means for generating a proportional signal.

According to another embodiment, the detection means of the proportional type are distinct from those used by the first means for generating a proportional signal.

Advantageously, the means for comparing the value supplied by the detection means with at least one threshold comprise a generator of at least one threshold value and at least one comparator of the output signal of the detection means of the proportional type with this at least one threshold value.

According to one embodiment, the comparators are of the single or hysteresis comparator type.

Advantageously, the detection means comprise a Hall effect sensor.

Advantageously, the device comprises filters for protection against electromagnetic interference.

According to one embodiment, the output signals are amplified by amplification means, in particular by a transistor.

Advantageously, the output signal of the second generation means consists of two individual signals on two output channels.

Advantageously, each individual signal on a given output channel is equal to a determined value when the actuation portion is actuated in a first direction relative to the neutral position, based on a movement threshold value, and equal to a second value, in particular zero, when the actuation is carried out in the opposite direction or when the movement in the first direction is below the threshold.

BRIEF DESCRIPTION OF THE DRAWINGS

In any case, the invention will be well understood with the aid of the following description, with reference to the appended schematic drawing, representing as a nonlimiting example several embodiments of a device according to the invention.

DESCRIPTION OF THE PREFERRED EMBODIMENTS

Figure 1:
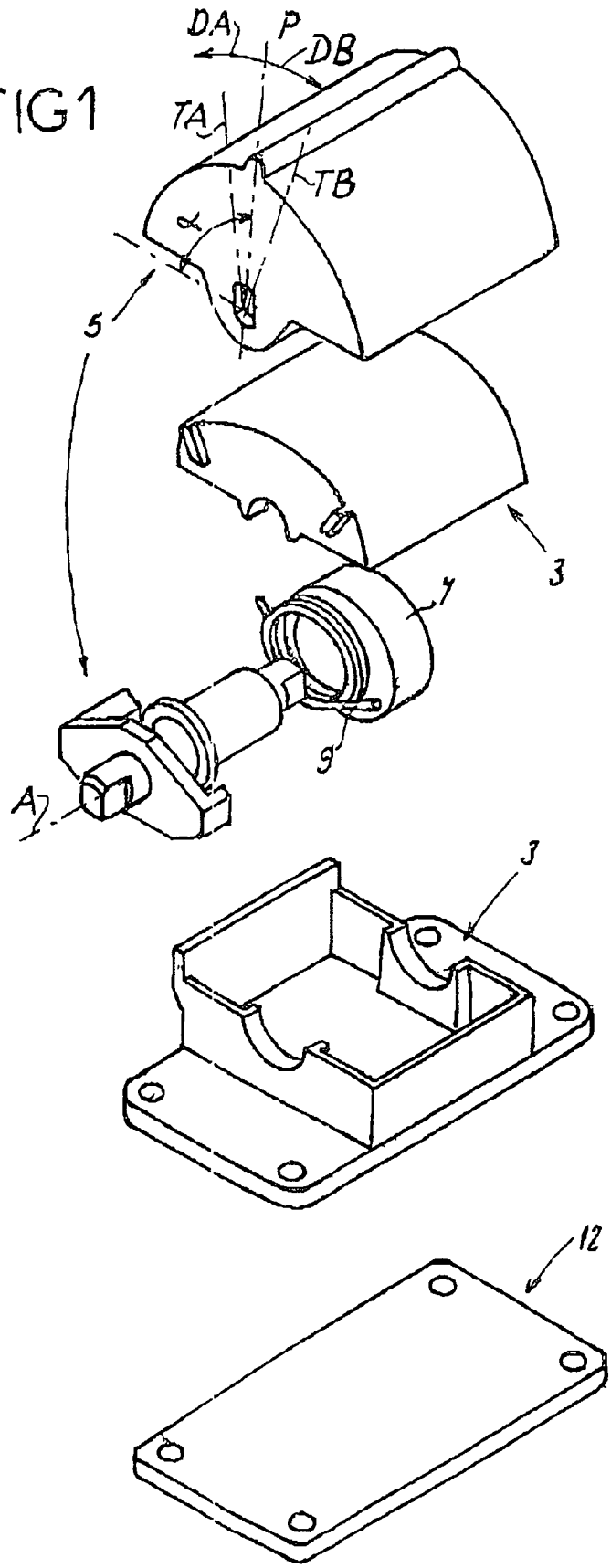
FIG. 1 is an exploded view in perspective of a device according to a first embodiment.
Figure 2:
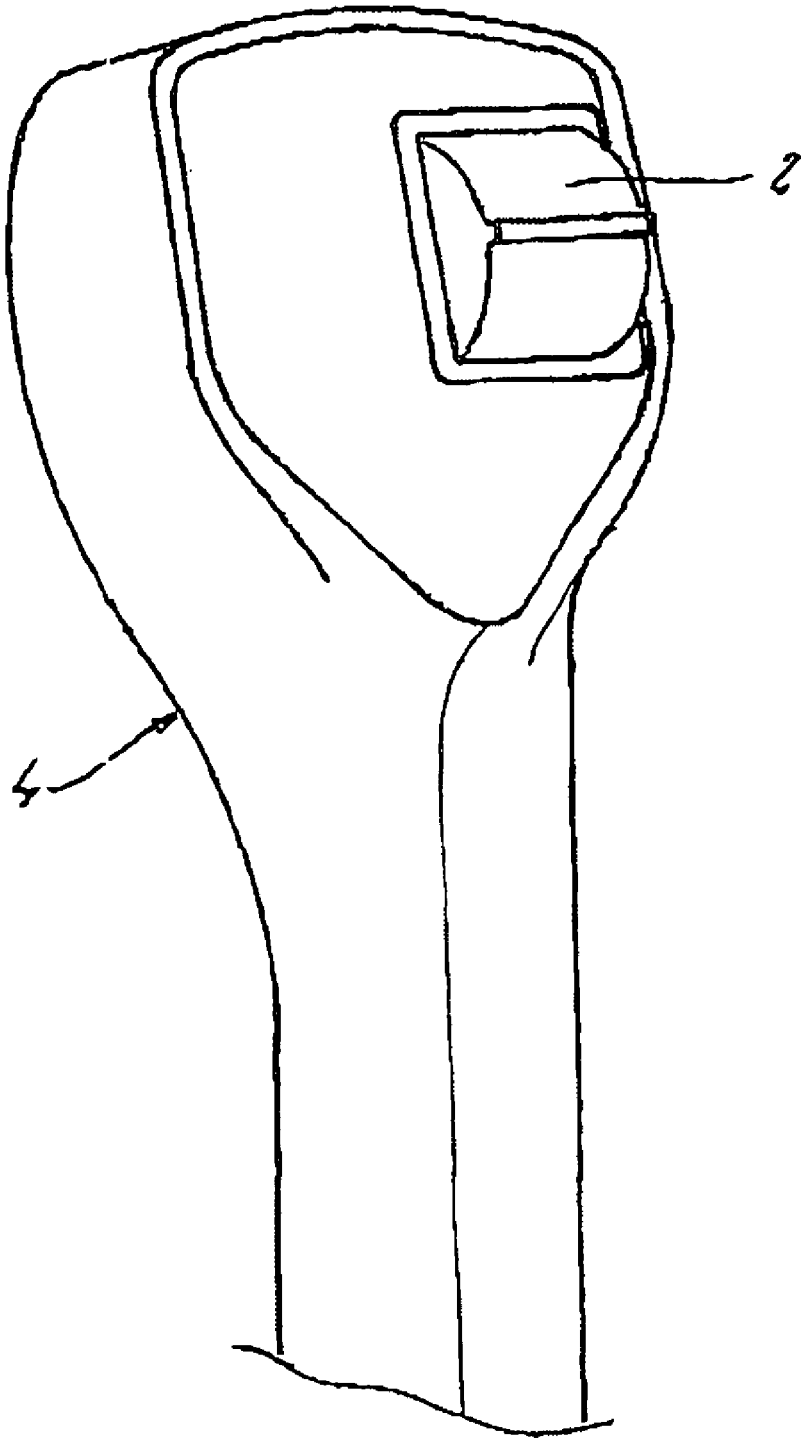
FIG. 2 is a view in perspective of the device of FIG. 1 attached to a remote control handle of a heavy construction machine.

As shown in FIGS. 1 and 2, a rotary control device 2 according to the invention comprises:

- a casing 3 designed to be fixedly attached to the handle 4,
- a movable actuation portion 5 that can be rotated relative to the casing 3 about an axis A,
- first means 6 for generating a proportional control signal S1 based on the angular position of the movable actuation portion 5, comprising a movable portion 7 and a portion 8 fixedly attached to the casing, consisting respectively of a magnet 7 fixedly attached rotatably to the actuation portion 5 and a first Hall effect sensor 8.

The movable actuation portion 6 may be moved by the operator in two opposite directions DA and DB from a rest position P against elastic means 9.

According to an essential feature of the invention, the device 2 also comprises second means 10 for generating at least one signal S2 of the on/off type delivering a first signal value when the actuation portion 5 is oriented in a first direction DA relative to the rest position P, beyond a first threshold TA, and delivering a second signal value when the actuation portion 5 is oriented in a second direction DB relative to the rest position P, beyond a second threshold TB.

The second means 10 for generating a signal are placed on the casing of the control device, in the form of a printed circuit or a card 12 to which is also attached the fixed portion of the first generation means 6, comprising the first Hall effect sensor 8.

Figure 3:
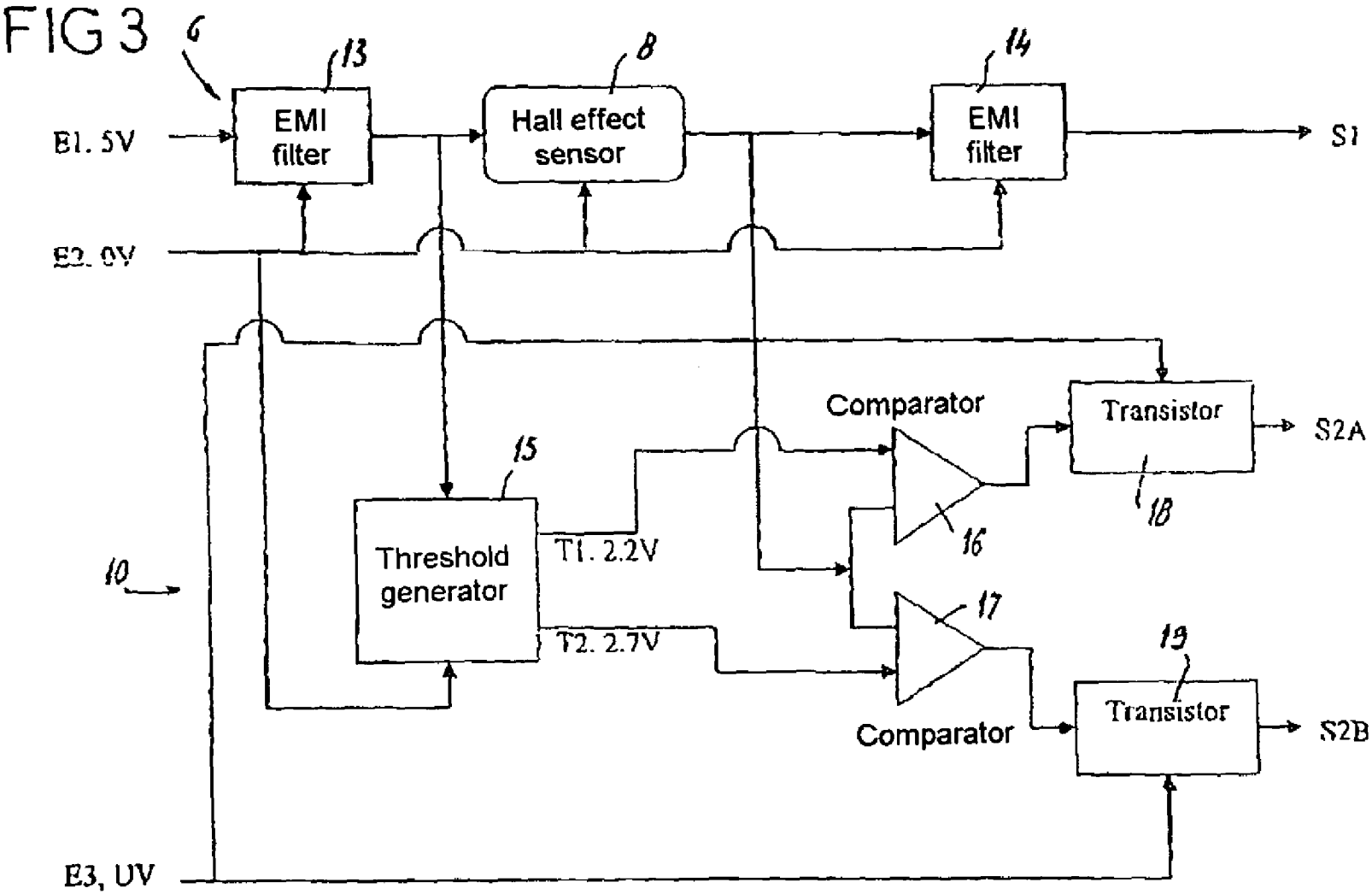
FIG. 3 is a schematic view of the means for generating control signals used in the device of FIG. 1.

According to a first embodiment, shown in FIG. 3, the card 12 has three inputs:

- a first 5V power supply input E1,
- a second 0V potential input E2,
- a third power supply input E3 at a potential determined at a constant value of +UV.

The card 12 also has three outputs:

- a first output S1 corresponding to the proportional signal generated by the first means,
- a second output S2A and a third output S2B that supply an output signal S2 of the on/off type of the second generation means 10 consisting of two individual signals on the two output channels.

The fixed portion of the first generation means 6 comprises, in series, and supplied between the first input E1 and the second input E2:

- a first filter 13 designed for protection against electromagnetic interference, or an EMI filter,
- the Hall effect sensor 8, and
- a second EMI filter 14.

The output S1 corresponds to the output of the second EMI filter 14. This output value is a value proportional to the movement of the actuation portion.

In particular, in this embodiment, the output voltage lies between 0 and 5V, these extreme values corresponding to the values of the inputs E1 and E2, a position of the actuation portion in the vicinity of the rest position P corresponding to a rest value VR of the order of 2.5V.

The second generation means comprise detection means of the proportional type associated with means for comparing the value supplied by the detection means with two thresholds TA and TB.

In particular, in this embodiment, the detection means of the proportional type consist of the first Hall effect sensor 8 also used by the first means 6 for generating a proportional signal.

The means for comparing the value supplied by the detection means with at least one threshold comprise a generator 15 of the threshold values TA and TB and two hysteresis comparators 16 and 17 of the output signal of the detection means of the proportional type with the two threshold values TA and TB.

In this embodiment, the thresholds TA and TB have the respective values 2.2 and 2.7V, these values being on either side of the 2.5V rest value VR.

The generator 15 of the threshold values is supplied by the inputs E1 and E2.

The output signals of each of the two comparators 16 and 17 are amplified by amplification means, consisting respectively of two transistors 18 and 19, whose supply is provided by the input E3.

The individual amplified signals are then connected respectively to the outputs S2A and S2B.

The value of each individual signal present at one of the outputs S2A and S2B is equal to a determined value corresponding substantially to the value of UV of the input signal E3 when the actuation portion 5 is actuated in a given direction DA, DB relative to the neutral position P, based on a movement threshold value TA, TB and equal to zero when the actuation takes place in the opposite direction.

The use of the thresholds TA and TB makes it possible not to generate an output signal when the actuation portion is in the vicinity of its rest position P.

Figure 4:
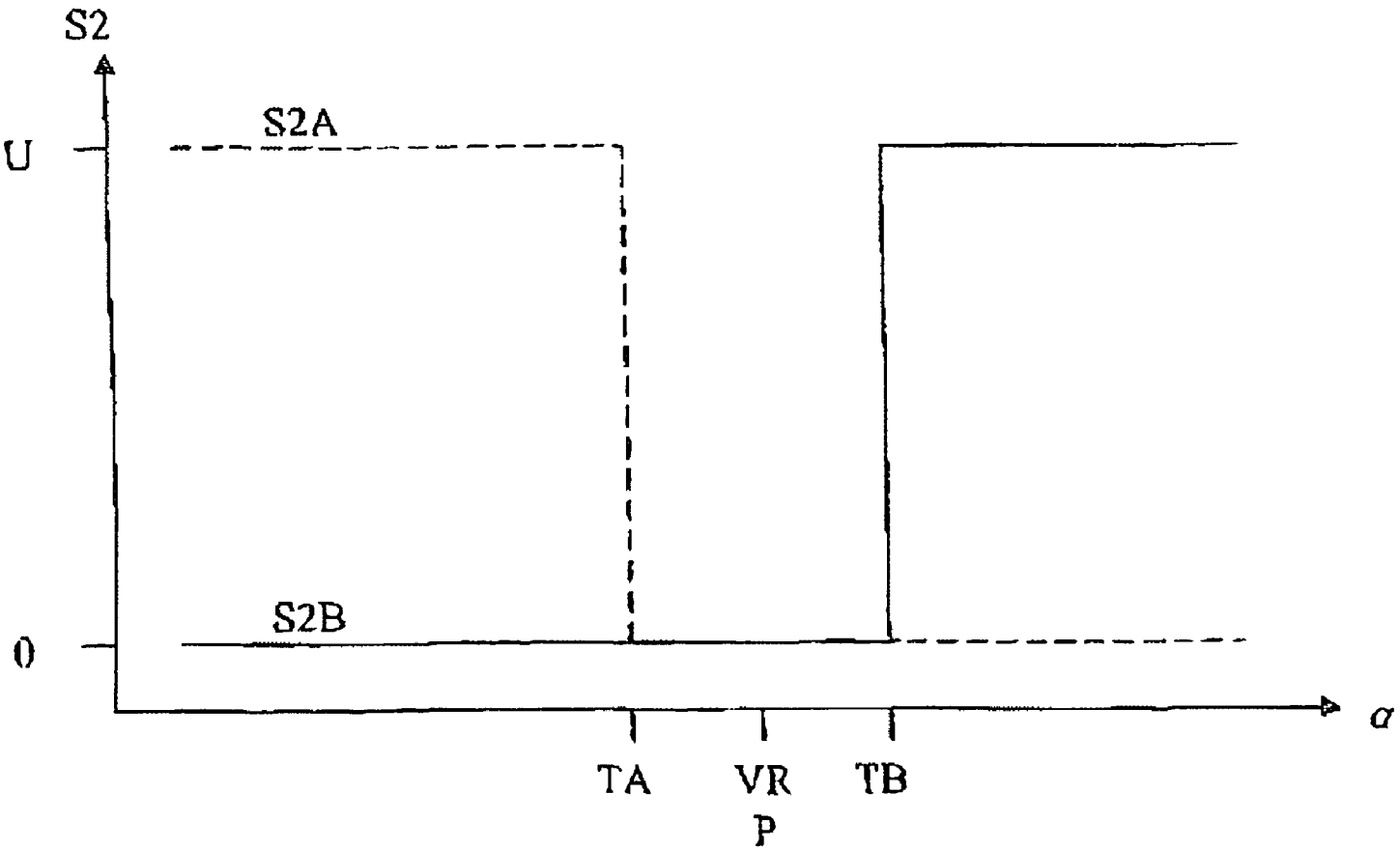
FIG. 4 is a schematic view of the output characteristic of the second means for generating a control signal.

The output characteristic S2 of the second generation means 10, consisting of the characteristics on the two output channels S2A and S2B, is shown in FIG. 4, representing on the ordinate the output value, and on the abscissa the angular position a of the actuation portion 5 also corresponding to the voltage at the terminals of the detection means consisting of the Hall effect sensor.

The characteristic of S2A is represented in dot-and-dash lines and that of S2B in continuous lines.

Using the outputs S2A and S2B, the card 12 therefore makes it possible to determine the direction of actuation with an on/off signal.

According to a second embodiment, a device 2 according to the invention comprises the same elements bearing the same reference numbers as in the first embodiment, as described with reference to FIGS. 1 and 2, and has a similar output characteristic to that described with reference to FIG. 4.

Figure 5:
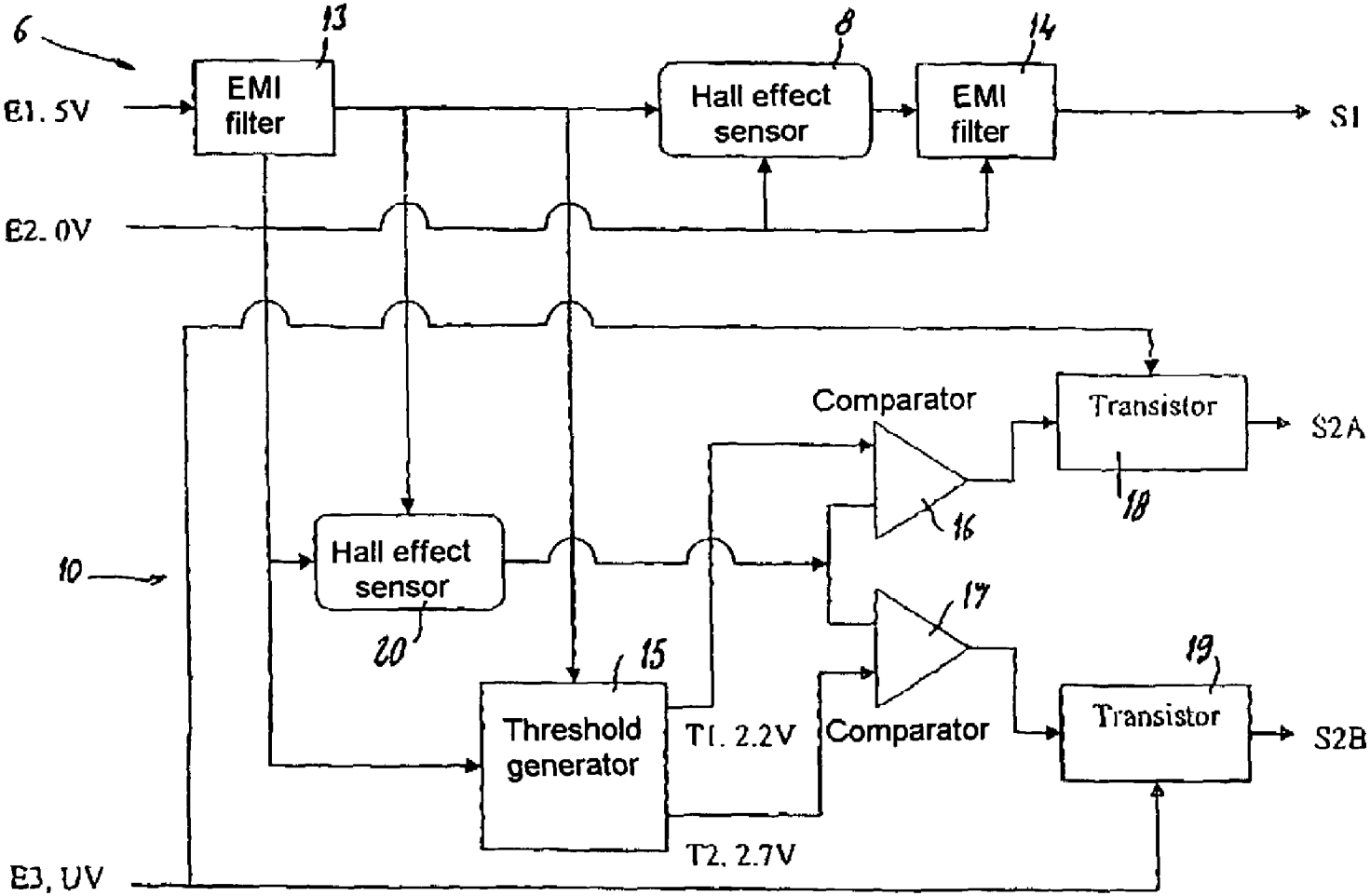
FIG. 5 is a schematic view of the means for generating control signals according to a second embodiment.

The second means 10 for generating an on/off signal represented in FIG. 5 use the same elements as in the first embodiment, except for the detection means of proportional type that consist of a second Hall effect sensor 20 of proportional type distinct from that used by the first means 6 for generating a proportional signal.

This arrangement is advantageous because it makes it possible to provide redundancy of the measurements making it possible to detect any failure of the first sensor.

According to a third embodiment, a device 2 according to the invention comprises the same elements bearing the same reference numbers as in the first embodiment, as described with reference to FIGS. 1 and 2, and has a similar output characteristic to that described with reference to FIG. 4.

Figure 6:
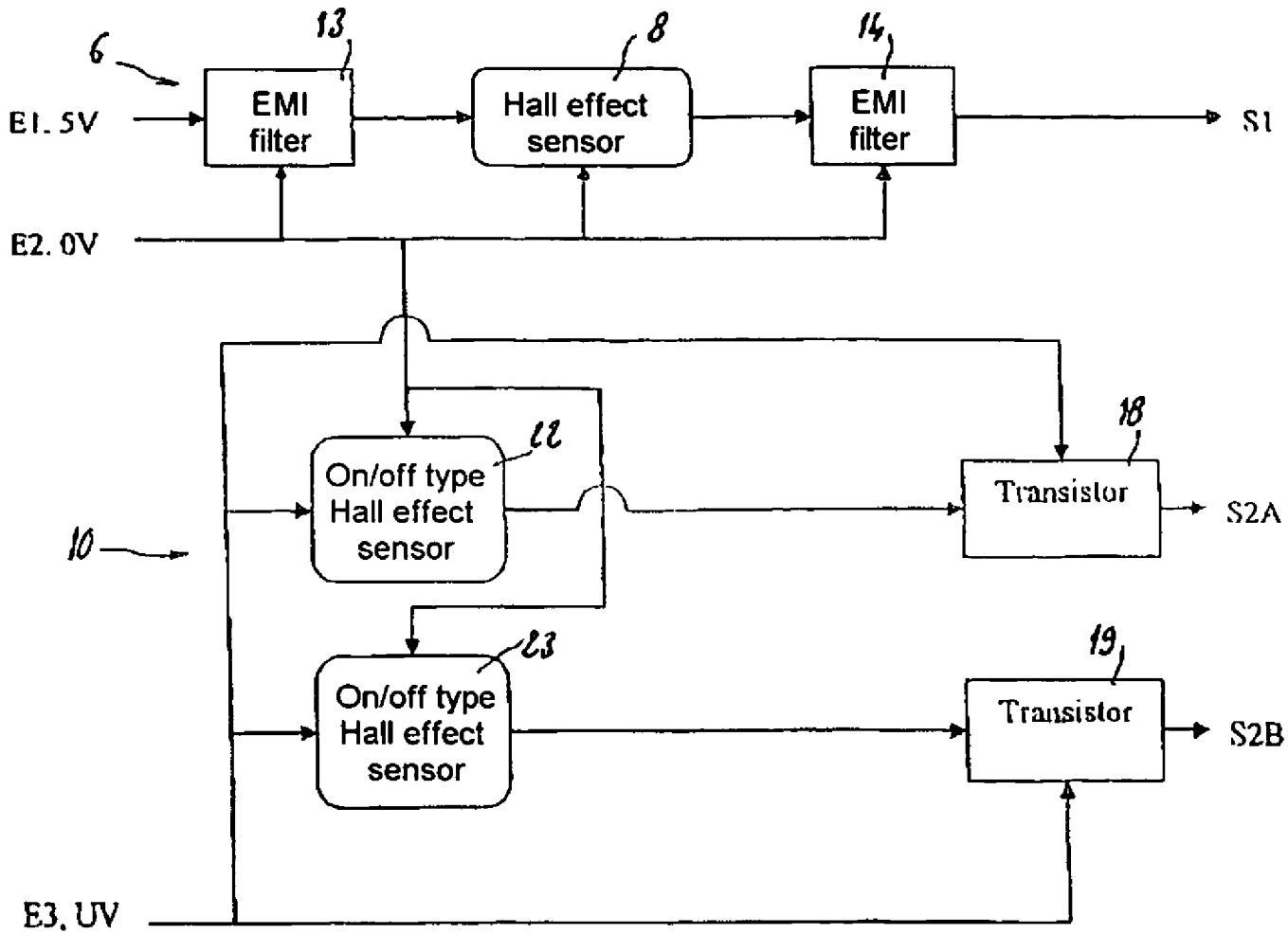
FIG. 6 is a schematic view of the means for generating control signals according to a third embodiment.

However, the second generation means, shown in FIG. 6, comprise detection means of the on/off type comprising:

- first means for detecting the movement of the actuation portion 5 in a first direction DA relative to the rest position P, consisting of a first Hall effect sensor 22 of the on/off type, and
- second means for detecting the movement of the actuation portion in a second direction DB relative to the rest position P, consisting of a second Hall effect sensor 23 of the on/off type.

In this embodiment, the use of comparators and of a generator of threshold values is not necessary, the sensors delivering an output signal when the position of the actuation portion passes beyond a given threshold TA, TB.

The output signal of each of the on/off type Hall effect sensors 22, 23 is therefore directly connected respectively to one of the transistors 18 and 19.

The card 12, thus made with a smaller number of components, produces an output characteristic similar to that of FIG. 4.

Figure 7:
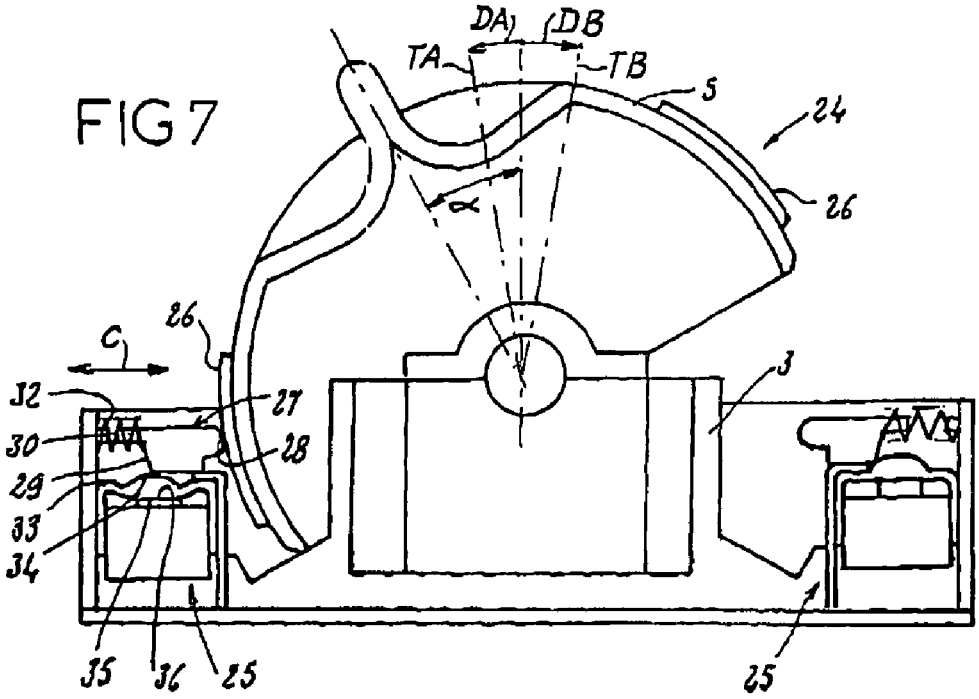
FIG. 7 is a front view of the device according to a fourth embodiment.

According to a fourth embodiment, shown in FIG. 7, the device 24 comprises, in a similar manner to the device of the first embodiment:

- a casing 3 designed to be fixedly attached to a handle of a remote control of a heavy construction machine,
- a movable actuation portion 5 that can be rotated relative to the casing 3 about an axis A, of which only a portion consisting of a stud is shown in FIG. 7,
- first means for generating a proportional control signal S1 based on the angular position of the movable actuation portion, not shown in FIG. 7.

As in the first embodiment, the movable actuation portion may be moved by the operator in two opposite directions from a rest position, against elastic means.

The above elements are similar to those described in the first embodiment.

The device 24 also comprises second means for generating at least one signal S2 of the on/off type delivering a first signal value when the actuation portion 5 is oriented in a first direction DA relative to the rest position P, beyond a first threshold TA, and delivering a second signal value when the actuation portion 5 is oriented in a second direction DB relative to the rest position P, beyond a second threshold TB.

The second signal generation means are placed on the casing of the control device and comprise two symmetrical arrangements 25 situated on either side of the actuation portion and comprising:

- a ramp 26 on the external portion of the stud 5,
- a traveler 27, a member that can be moved in translation in a sliding direction C, comprising a first end 28 designed to interact with the ramp 26, a portion having a plane 29 inclined relative to the direction C and a second end 30 subjected to the action of a return spring 32,
- a sealed elastic bellows 33, that can be moved in a direction transversal to the direction C, and comprising a boss 34 designed to interact with the inclined plane of the traveler,
- a pushbutton 35, interacting with the face 36 of the bellows 33 opposite to the boss.

In the rest position, the ramps 26 of the two arrangements 25 do not interact with the travelers 27, the latter being held in a retracted position relative to the sealed bellows by the return springs, the two pushbuttons 35 being in the "out" position.

As shown in FIG. 7, when the actuation portion 5 is oriented in a first direction DA relative to the rest position P, beyond a first threshold TA, the ramp 26 interacts with the traveler 27 that moves against the spring 32 in the direction C away from the axis A of rotation of the actuation portion.

The inclined plane 29 interacts with the boss 34 of the bellows 33, this bellows being pushed downward against its elastic return force, the face 36 of the bellows pushing in the pushbutton 35.

In this position, the second ramp 26 is not in contact with the first traveler 27 of the second arrangement 25, the second pushbutton 35 therefore being in the "out" position.

Conversely, when the actuation portion 5 is oriented in a second direction DB relative to the rest position P, beyond a second threshold TB, a second ramp 26, symmetrical to the first, interacts with a second traveler 27 of a second arrangement 25, similarly pushing in a second pushbutton 35.

The first ramp 26 is no longer in contact with the first traveler of the first arrangement, the first pushbutton 35 therefore being in the "out" position.

The two arrangements 25 forming the second generation means make it possible to compose an output signal S2 of the on/off type, consisting of two individual signals at two outputs S2A and S2B representing the signal of the two push-buttons 35, the output characteristic therefore being similar to that of the device of the first embodiment, as shown in FIG. 4.

The presence of the bellows makes it possible to seal the device.

Figure 8:
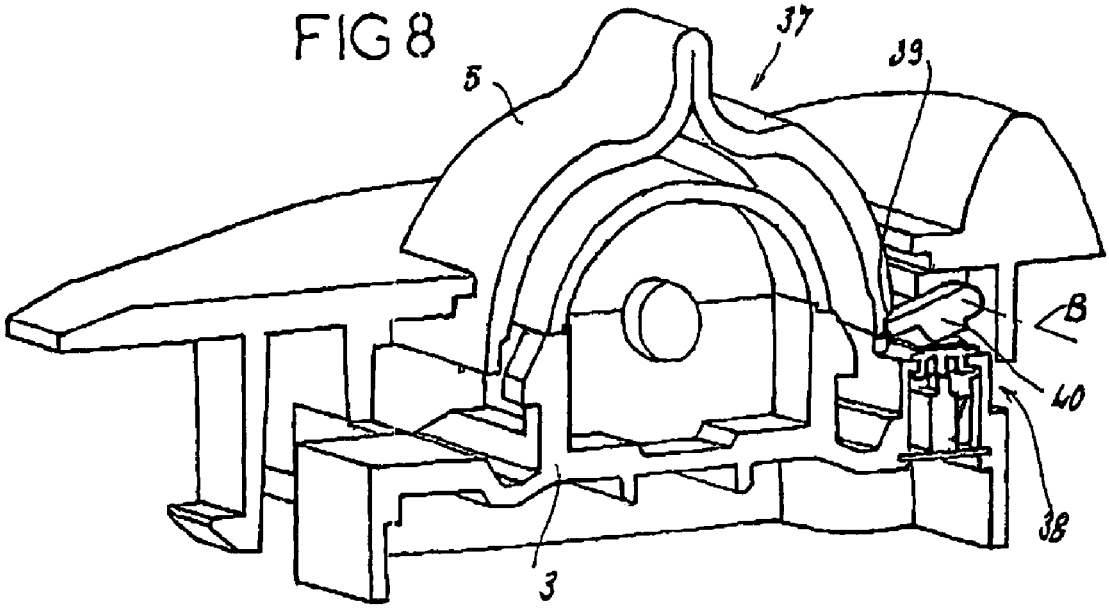
FIGS. 8, 9, 10 are front views of the device according to a fifth embodiment, in three different positions.
Figure 9:
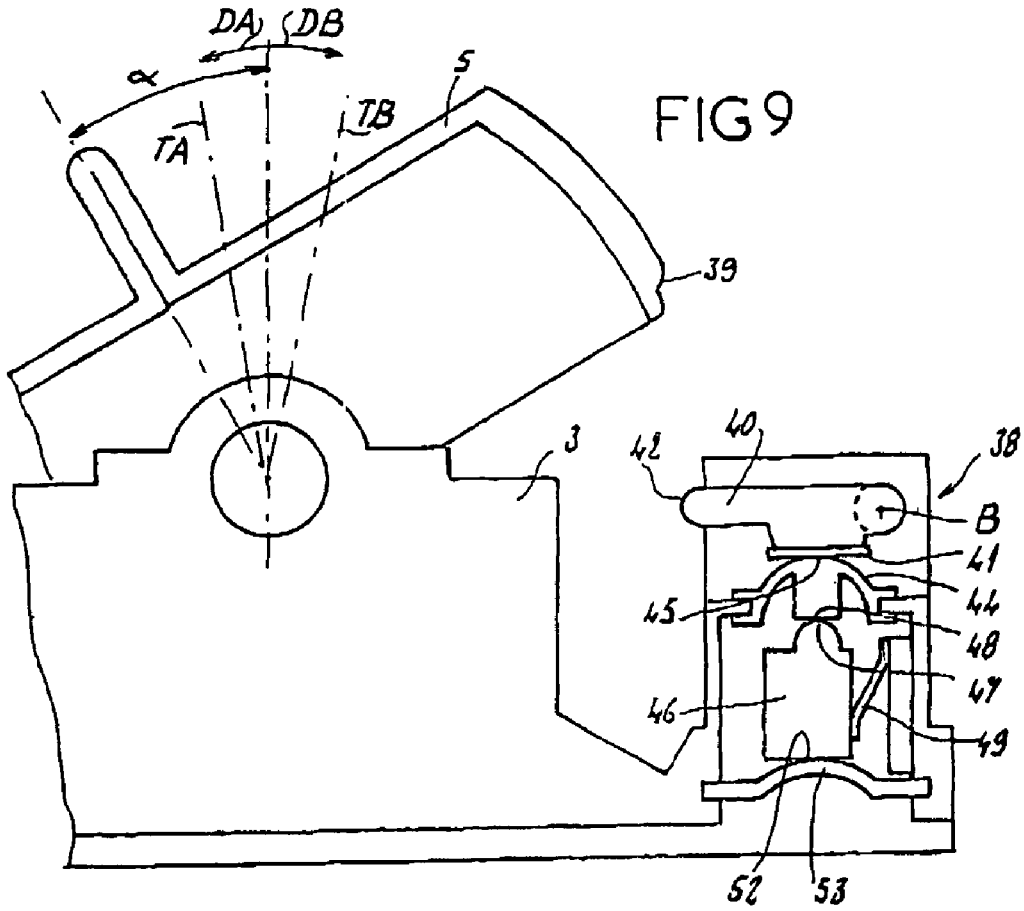
Figure 10:
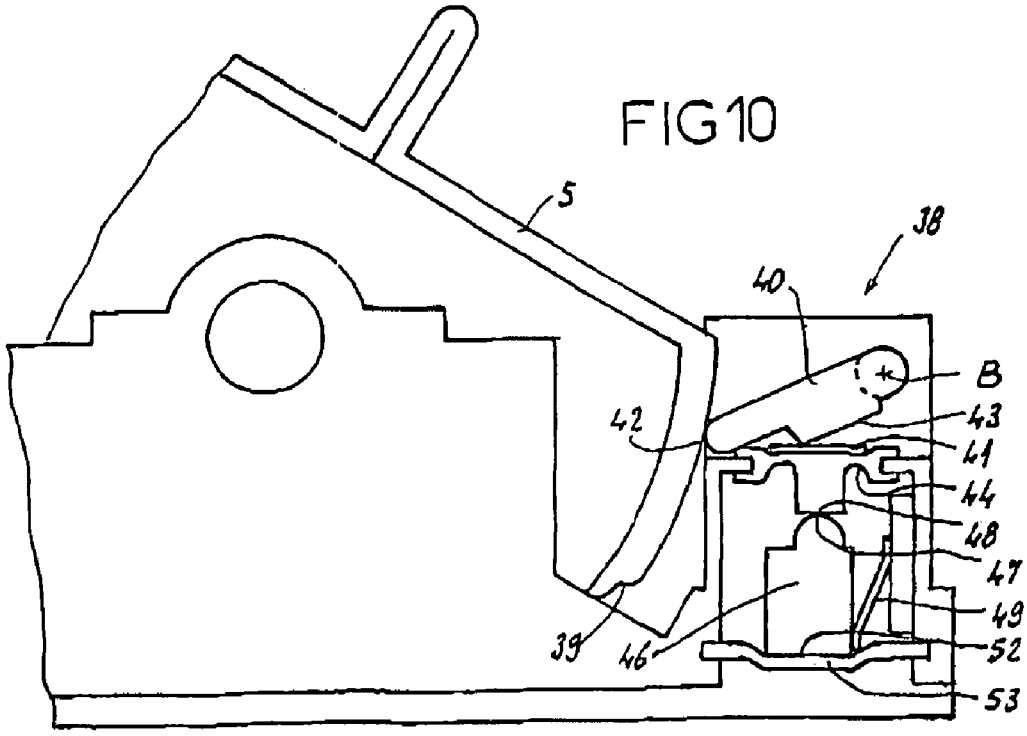

According to a fifth embodiment, shown in FIGS. 8 to 12, the device 37 comprises, in a manner similar to the device of the first embodiment:

- a casing 3 designed to be fixedly attached to a handle of a remote control of a heavy construction machine,
- a movable actuation portion 5 that can be rotated relative to the casing 3 about an axis A, of which only one portion consisting of a stud is shown in FIGS. 8 to 10,
- first means for generating a proportional control signal S1 based on the angular position of the movable actuation portion, not shown in FIGS. 8 to 10.

As in the first embodiment, the movable actuation portion may be moved by the operator in two opposite directions from a rest position against elastic means.

The above elements are similar to those described in the first embodiment.

The device 37 also comprises second means 38 for generating at least one signal S2 of the on/off type delivering a first signal value when the actuation portion 5 is oriented in a first direction DA relative to the rest position P, beyond a first threshold value TA, and delivering a second signal value when the actuation portion 5 is oriented in a second direction DB relative to the rest position P, beyond a second threshold TB.

The second means 38 for generating a signal are placed on the casing of the control device and comprise:

- a bearing ramp 39 on the outer portion of the stud of the actuation portion 5, forming a bearing abutment on its front edge,
- a cam 40, that can rotate relative to the casing about an axis B parallel to the axis A of rotation of the actuation portion 5, comprising an arm designed to interact via its end 42 with the bearing ramp 39 of the stud,
- an elastic sealed bellows 44, that can be moved in a direction E transverse to the axis B, and comprising a boss 45 designed to interact with a contact surface 43 of the arm of the cam 40, by means of an intermediate metal plate 41, in order to prevent a direct contact between the bellows and the cam that would not have a satisfactory friction coefficient,
- a traveler 46, a member that can be moved in translation in the sliding direction E, comprising a first end 47 designed to interact with the face 48 of the bellows 44 opposite to the boss, a lateral portion to which is attached at least one pair of conductive brushes 49, 50, electrically connected, and a second end 52 subjected to the action of a return spring 53,
- at least a couple of conductive tracks 54, 55 attached to a wall of the casing 3 parallel to the direction E so as to be able to enter into contact respectively with the first and the second brush of the couple of brushes 49, 50.

The return spring 53 makes it possible to keep the traveler 46 in contact with the bellows 44, the bellows in contact with the cam 40.

Via the end of its arm 42, the cam is:

- in contact with the abutment of the bearing ramp 39 of the stud of the actuation portion 5 of the device 37, in the rest position of the system,
- in contact with the bearing ramp, beyond the abutment, when the actuation portion is moved in the direction DB, beyond the threshold TB.

The arm is not in contact with the bearing ramp, when the actuation portion is moved in the direction DA, beyond the threshold TA.

Therefore, according to the angle $\alpha$ formed by the actuation portion with the rest position, the slide is moved in the direction E, and the couple of brushes 49, 50 attached to the traveler. In particular, according to the representation of FIGS. 8 to 11, when the actuation portion moves in the direction DA, the traveler 46 rises, and when the actuation portion moves in the direction DB, the traveler 46 descends.

Figure 11:
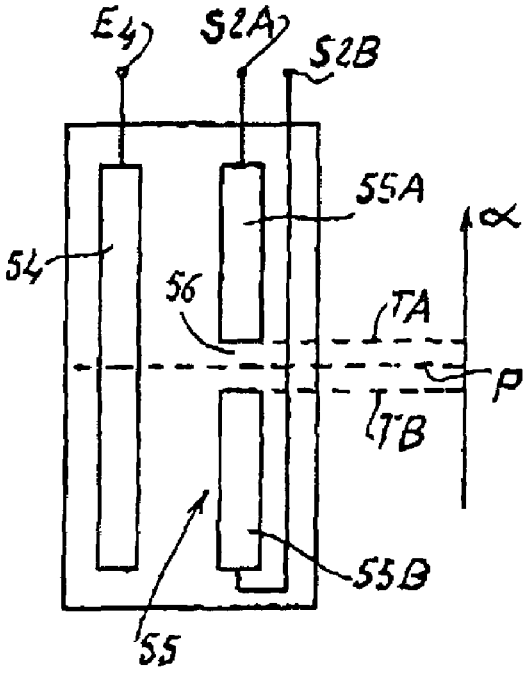
FIG. 11 is a detail schematic view of the conductive tracks of the device of FIG. 8.
Figure 12:
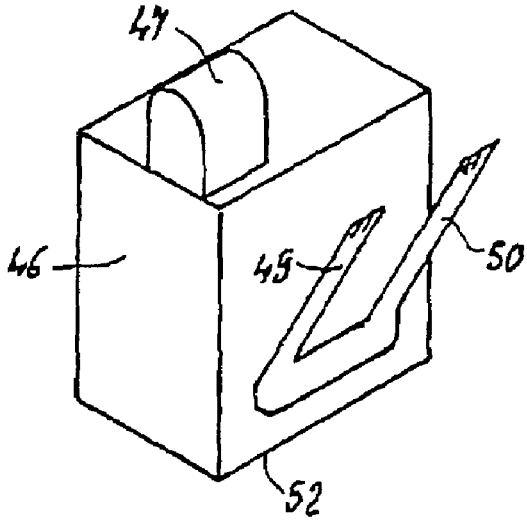
FIG. 12 is a view in perspective of the traveler used in the device of FIG. 8.

As shown in FIG. 11, the first track 54 is continuous and connected to a supply input E4.

The second track is separated into two electrically insulated portions 55A and 55B, separated by a nonconductive strip 56, the first portion 55A being connected to a first output S2A and the second portion 55B being connected to a second output S2B.

The couple of brushes 49, 50 makes it possible, according to the position of the traveler, to connect the first track 54 to the first portion 55A or to the second portion 55B of the second track, or to leave the circuit open, if the second brush is in contact with the conductive strip 56. Thus, according to these configurations, a signal will be emitted at the outputs S2A or S2B or no signal will be emitted.

As shown in FIG. 8, in the rest position of the device 37, the second brush 50 is at the nonconductive strip 56, the circuit connecting the input E4 being open, no output signal being emitted.

As shown in FIG. 9, when the actuation portion 5 is oriented in a first direction DA relative to the rest position P, beyond a first threshold TA, the traveler rises relative to the rest position, the second brush 50 is in contact with the first portion 55A of the second track, the input E4 is connected to the output S2A, an output signal being emitted at this output.

As shown in FIG. 10, when the actuation portion 5 is oriented in a second direction DB relative to the rest position P, beyond a second threshold TB, the traveler rises relative to the rest position, the second brush 50 is in contact with the second portion 55B of the second track, the input E4 is connected to the output S2B, an output signal being emitted at this output.

The second generation means 38 make it possible to compose an output signal S2 of the on/off type, composed by two individual signals on two output channels S2A and S2B, the output characteristic therefore being similar to that of the device of the first embodiment, as shown in FIG. 4.

It goes without saying that the invention is not limited to the preferred embodiments described above, as a nonlimiting example; on the contrary, it covers all the variant embodiments in the context of the following claims.

What is claimed is:

1. A rotary control device designed in particular to be attached to a handle of a remote control of a heavy construction machine, comprising:

- a casing designed to be fixedly attached to the handle,
- a movable actuation portion that can be rotated relative to the casing about an axis,
- first means for generating a proportional control signal based on the angular position of the movable actuation portion, comprising a movable portion moved by the actuation portion and a portion fixedly attached to the casing, the movable actuation portion being able to be moved by the operator in two opposite directions from a rest position against elastic means, which device also comprises second means for generating at least one signal of the on/off type delivering a first signal value when the actuation portion is oriented in a first direction relative to the rest position, beyond a first threshold, and delivering a second signal value when the actuation portion is oriented in a second direction relative to the rest position, beyond a second threshold.

2. The device as claimed in claim 1, wherein the second means for generating a signal are placed on the casing of the device.

3. The device as claimed in claim 1, wherein the second means for generating a signal comprise at least one member that is movable, particularly in translation, moved by the actuation portion against elastic return means.

4. The device as claimed in claim 3, wherein the actuation portion comprises at least one ramp or a bearing abutment designed for the movement of the movable member.

5. The device as claimed in claim 3, wherein the second means for generating a signal comprise at least one pushbutton that can be actuated during the movement of the movable member.

6. The device as claimed in claim 3, wherein the movable member comprises conductive elements designed to enter into contact with at least one conductive track in at least one position of the device.

7. The device as claimed in claim 6, wherein the conductive elements are in open circuit in the rest position of the device.

8. The device as claimed in claim 6, wherein the conductive elements comprise flexible brushes making an electric sliding contact with at least one electric track in at least one position of the device.

9. The device as claimed in claim 1, wherein the second generation means comprise first means for detecting the movement of the actuation portion in a first direction relative to the rest position and second means for detecting the movement of the actuation portion in a second direction relative to the rest position.

10. The device as claimed in claim 1, wherein the second generation means comprise detection means of the on/off type.

11. The device as claimed in claim 10, wherein the detection means comprise a Hall effect sensor.

12. The device as claimed in claim 10, which device comprises filters for protection against electromagnetic interference.

13. The device as claimed in claim 1, wherein the second generation means comprise detection means of the proportional type associated with means for comparing the value supplied by the detection means with at least one threshold.

14. The device as claimed in claim 13, wherein the detection means of the proportional type are common with those used by the first means for generating a proportional signal.

15. The device as claimed in claim 13, wherein the detection means of the proportional type are distinct from those used by the first means for generating a proportional signal.

16. The device as claimed in claim 13, wherein the means for comparing the value supplied by the detection means with at least one threshold comprise a generator of at least one threshold value and at least one comparator of the output signal of the detection means of the proportional type with this at least one threshold value.

17. The device as claimed in claim 16, wherein the comparators are of the single or hysteresis comparator type.

18. The device as claimed in claim 1, wherein the output signals are amplified by amplification means, in particular by a transistor.

19. The device as claimed in claim 1, wherein the output signal of the second generation means consists of two individual signals on two output channels.

20. The device as claimed in claim 1, wherein each individual signal on a given output channel is equal to a determined value when the actuation portion is actuated in a first direction relative to the neutral position, based on a movement threshold value, and equal to a second value, in particular zero, when the actuation is carried out in the opposite direction or when the movement in the first direction is below the threshold.

* * * * *